US006402067B1

(12) United States Patent
Webster

(10) Patent No.: US 6,402,067 B1
(45) Date of Patent: Jun. 11, 2002

(54) REFINER FOR FIBROUS MATERIAL

(75) Inventor: David R. Webster, Westmount (CA)

(73) Assignee: H.J.G. McLean Limited (CA)

( * ) Notice: Subject to any disclaimer, the term of this patent is extended or adjusted under 35 U.S.C. 154(b) by 0 days.

(21) Appl. No.: 09/590,381

(22) Filed: Jun. 9, 2000

(51) Int. Cl.[7] ..... B02C 7/12
(52) U.S. Cl. ..... 241/28; 241/261.3; 241/296
(58) Field of Search ..... 241/261.2, 261.3, 241/296, 297, 298, 28, 30

(56) References Cited

U.S. PATENT DOCUMENTS

| | | | | |
|---|---|---|---|---|
| 16,278 A | | 12/1856 | Kingsland, Jr. | |
| 1,532,649 A | | 4/1925 | Bieber | |
| 2,128,226 A | | 8/1938 | Atwood | |
| 2,412,680 A | | 12/1946 | Fisher et al. | |
| 2,727,695 A | | 12/1955 | Harries | |
| 2,912,174 A | | 11/1959 | Bidwell | |
| 3,614,826 A | | 10/1971 | Pilao | |
| 4,034,921 A | * | 7/1977 | Schnitzer | 24/261.3 |
| 4,874,136 A | | 10/1989 | Webster | |

FOREIGN PATENT DOCUMENTS

| | | |
|---|---|---|
| DE | 2202798 | 8/1973 |
| FR | 1589957 | 5/1970 |
| IT | 343852 | 10/1936 |

* cited by examiner

*Primary Examiner*—Mark Rosenbaum
(74) *Attorney, Agent, or Firm*—Diller, Ramik & Wight

(57) ABSTRACT

A pair of refiner members comprises respective refiner bars which cooperate to refine pulp. At least one the refiner bars extends in a spiral pattern for imparting a screw-like pumping action to the pulp. The refiner bars of the cooperating refiner members have different pitch to produce a differential pumping action and increase crossovers between the refiner members in order to improve refining. A sinuous curvature can also be introduced in the spiral pattern to further increase crossovers between the refiner members.

15 Claims, 2 Drawing Sheets

REFINER FOR FIBROUS MATERIAL

BACKGROUND OF THE INVENTION

1. Field of the Invention

The present invention relates to improvements in apparatuses for refining pulp and to a method for the refining of pulp.

2. Description of the Prior Art

Pulp refiners of the type comprising a pair of refiner members having opposed facing refining surfaces defining a gap therebetween for receiving a material to be refined are well known in the art.

For instance, U.S. Pat. No. 4,874,136 issued on Oct. 17, 1989 to Applicant discloses a pulp refiner comprising a pair of cooperating refiner members having identical plain spiral refining edges. The spiral refining edges face each other and have many intersections, characterized as crossovers. The discs are normally driven at equal rotary speeds but in opposite directions. As a result, a locus of any such crossover moves straight along a stationary line as a radius.

Although such cooperating spiral patterns have been found suitable in that they apply a smooth, low-audible, screw-like, sliding-pinching action to the material to be refined, thereby reducing wear of and power consumption, it has been found that when both plain spiral patterns pump outward, the flow is strong but the refining is weak, leaving a deficiency problem for some grades of pulp.

SUMMARY OF THE INVENTION

It is therefore an aim of the present invention to improve pulp refining using spiral refining patterns.

It is also an aim of the present invention to increase crossovers and hydraulic shear. in a refining zone.

Therefore, in accordance with the present invention, there is provided a pair of cooperating refiner members having opposed facing refining surfaces defining a gap therebetween for receiving a material to be refined, each said refining surface being formed with alternating grooves and lands, the lands of one refining surface intersecting the lands of the other refining surface to form crossovers therewith, wherein at least one of said refiner member is rotatable, and wherein said grooves and lands defined in said at least one refiner member extend in a continuous spiral pattern of at least one revolution for providing a screw-like pumping action on the material when said at least one refiner member is rotated, said continuous spiral pattern of said at least one refiner member being different from a refining pattern of the other cooperating refiner member to provide additional crossovers and increased hydraulic shear between said refining surfaces compared to refiner members having similar patterns of grooves and lands.

In accordance with a further general aspect of the present invention, there is provided a pair of cooperating refiner members, at least one of said refiner member being rotatable and having a sinuous spiral refining pattern defined thereon in order to increase an area of crossovers between said refiner members.

In accordance with a further general aspect of the present invention, there is provided a method of refining material, comprising the steps of: providing a pair of refining surfaces having different refining patterns, operating said refining surfaces by rotating at least one of said refining surfaces to impart a screw-like pumping and pinching action to the material to be refined, and introducing the material to be refined between said refining surfaces.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
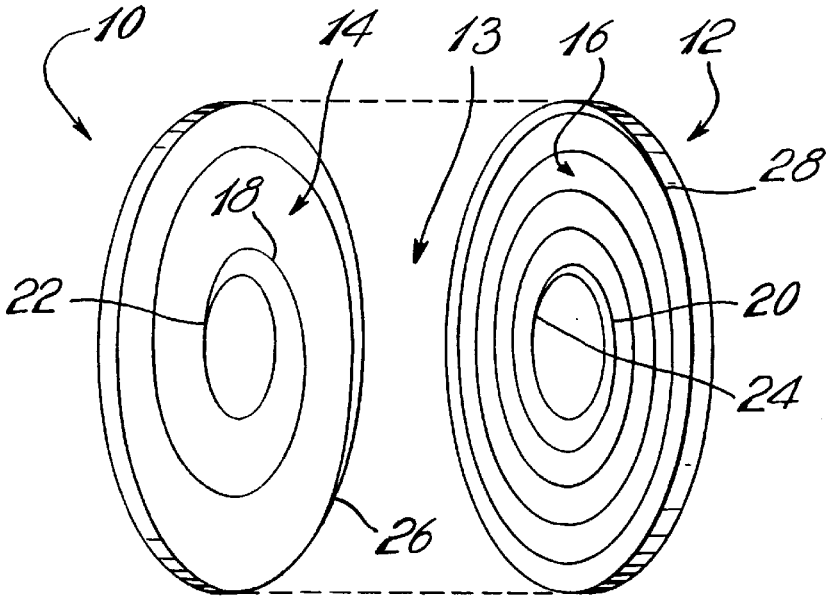
FIG. 1 is a diagrammatic, exploded view of a pair of cooperating refiner discs having different opposed refining surfaces in accordance with a first embodiment of the present invention.

FIG. 1 illustrates a pair of cooperating refiner discs 10 and 12 adapted to be mounted in a facing relationship on a common axis normal to the disc plane. The material to be refined is received in an adjustable gap 13 defined between the refiner discs 10 and 12. The refiner discs 10 and 12 are provided with respective opposed working surfaces 14 and 16 adapted to be disposed face-to-face to cooperate in refining the material introduced therebetween. In operation, one of the disc 10 and 12 may remain stationary while the other rotates or, alternatively, both discs 10 and 12 can be rotated in opposite hand directions or at different speeds so as to create shear planes that serves to refine material while the same flows from a central port (not shown) to the periphery of the refiner discs 10 and 12.

The working surfaces 14 and 16 of the refiner discs 10 and 12 each include a series of alternating grooves and lands extending in a continuous spiral pattern of at least one revolution. As diagrammatically illustrated in FIGS. 1 and 2, the working surfaces 14 and 16 thus includes respective plain spiral refining edges 18 and 20 extending continuously and uninterruptedly in a spiral pattern from respective first points 22 and 24 generally centrally of the discs 10 and 12 to respective second points 26 and 28 at the periphery of the discs 10 and 12.

As opposed to conventional pairs of cooperating spiral patterned discs which have the same pitch, i.e. the same distance between lands, the cooperating discs 10 and 12 are formed with spirals of different pitch. Indeed, as best seen in FIG. 1, the spiral of disc 12 has a smaller pitch than that of the spiral of disc 10 and, thus, the spiral of disc 12 has a higher number of turns or revolutions. By using a pair of refiner discs having refining spiral patterns of different pitch, the refining action on the material fed therebetween can be improved, as will be seen hereinafter.

Figure 2:
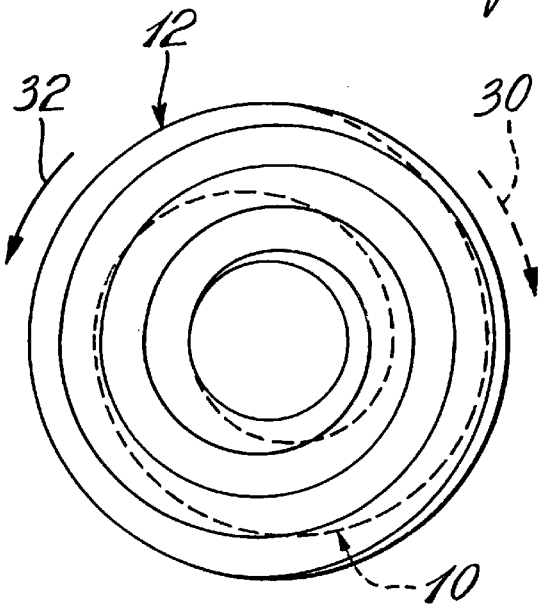
FIG. 2 is a diagrammatic, superposed view of the refiner discs of FIG. 1 showing the work-edge intersections thereof.

As seen in FIG. 2, the discs 10 and 12, which face one another, have refining edge intersections characterized as "crossovers". It has been found that by increasing the number of crossovers, for instance, by using cooperating facing spirals of different pitch, improved refining can be achieved.

According to the embodiment illustrated in FIGS. 1 and 2, the spirals of the discs 10 and 12 are manufactured with the same hand, i.e. the same direction of spiral, and in view of their facing relationship, the spirals thus extend in opposite directions when they are projected in a plane parallel to the working surfaces 14 and 16, as seen in FIG. 2. The discs 10 and 12 are rotated in counter-directions at a same speed, as indicated by arrows 30 and 32 in FIG. 2. Each disc 10, 12 is rotated in a direction opposite to the direction of the spiral thereof so as to provide an outward screw pump action on the material to be refined, thereby forcing the same outwardly towards the periphery of the discs 10 and 12. Accordingly, both discs 10 and 12 pump outward but at a different rate because of the different pitch of the spiral patterns thereof. The pumping differential causes hydraulic shear which improves refining of material.

Figure 3:
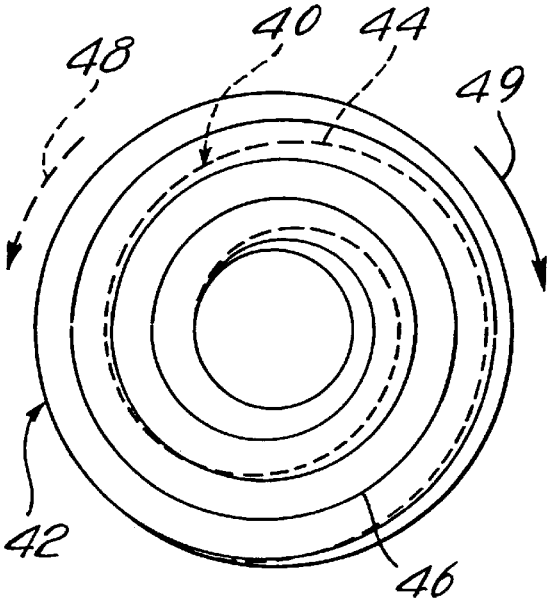
FIG. 3 is a diagrammatic, superposed view of a pair of cooperating refiner discs having different pitch and different spiral directions in accordance with a second embodiment of the present invention.

FIG. 3 illustrates another embodiment of the present invention wherein a pair of cooperating discs 40 and 42 are provided with respective spiral refining edges 44 and 46 of different pitches and opposite hands. The differential in pitch forms more crossovers than when the discs have equal pitches. The discs 40 and 42 are rotated at a same speed in counter-directions, as indicated by arrows 48 and 49. The rotation hand (direction of rotation) of the disc of lesser pitch, namely disc 42, is the same as the spiral hand thereof and, thus, disc 42 pumps inward. The rotation hand of disc 40 is opposite to its spiral hand and, thus, disc 40 pumps outward. Since the pitch of disc 40 is greater than the pitch of disc 42, the outward pumping will exceed the inward pumping, thereby creating high shear on the material discharged at the periphery of the discs 40 and 42. The resulting additional crossovers and shear increases the refining action produced on the material to be refined.

Figure 4:
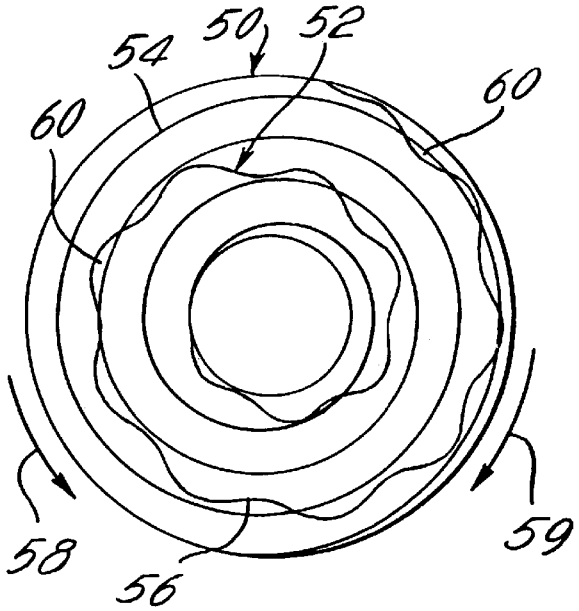
FIG. 4 is a diagrammatic, superposed view of a plain spiral refining pattern and a sinuous spiral refining pattern, the patterns having different pitch but same spiral direction in accordance with a third embodiment of the present invention.

FIG. 4 illustrates another embodiment of the present invention wherein a pair of cooperating refiner discs 50 and 52 are respectively provided with a plain spiral refining edge 54 and a sinuous spiral refining edge 56, the plain spiral edge 54 and the sinuous spiral edge 56 being of different pitch but same hands. As explained hereinbefore, the differential pitch provides additional crossovers. Furthermore, the sinuous shape of the refiner edge also contributes to provide additional crossovers. As seen in FIG. 4, pockets 60 are formed between the plain spiral edge 54 and the sinuous spiral edge 56. The ever-changing shapes of the pockets 60 produce an increased number of crossovers and increased shear, which both contribute to improve the refining.

The discs 50 and 52 are rotated at a same speed but in opposite directions, as depicted by arrows 58 and 59. Both discs 50 and 52 pump outward. The differential in pitch causes the disc having the greater pitch, i.e. disc 52, to pump more than disc 50 which has a smaller pitch. Hydraulic shear is thereby further increased as compared to conventional discs having equal pitches.

Figure 5:
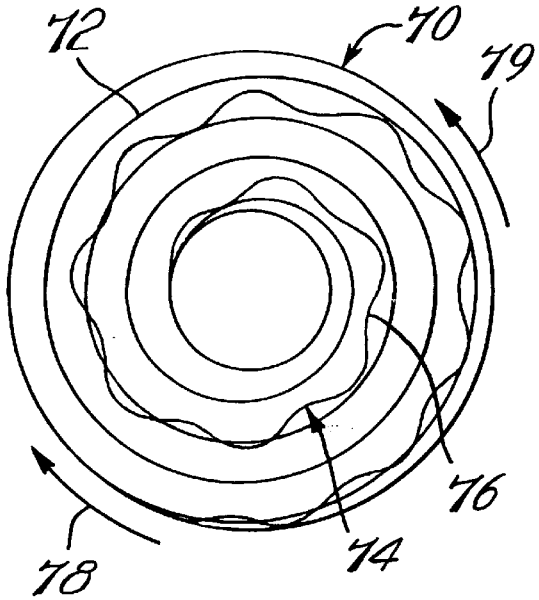
FIG. 5 is a diagrammatic, superposed view of a plain spiral refining pattern and a sinuous spiral refining pattern, the patterns having different pitch and spiral directions in accordance with another embodiment of the present invention.

FIG. 5 represents the mating of a plain spiral refining edge 72 of a disc 70 with a sinuous spiral refining edge 76 of a companion disc 74, the discs 70 and 74 being rotated at a same speed in opposite directions, as indicated by arrows 78 and 79, respectively. The spiral refining edges 72 and 76 have different pitch and opposite hands. The sinuous spiral pumps outward while the plain spiral pump inwards. The increased number of crossovers caused by the differential in pitch and the sinuous nature of the spiral 76 both contribute to improve the refining. The increased shear resulting from the pumping differential also contributes to improve the refining.

Figure 6:
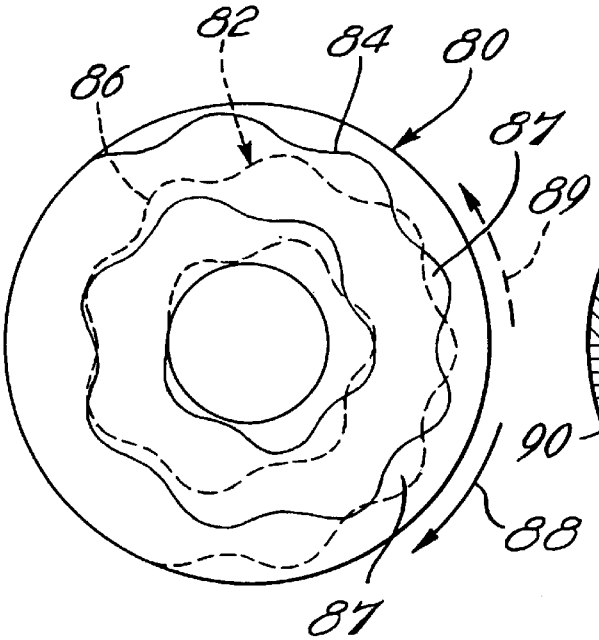
FIG. 6 is a diagrammatic, superposed view of a pair of sinuous spiral refining patterns having same pitch and same hand in accordance with a further embodiment of the present invention.

FIG. 6 illustrates a further embodiment of the present invention wherein a pair of refiner discs 80 and 82 having respective sinuous spiral refining edges 84 and 86 cooperate to refine a material fed therebetween. The discs are rotated at a same speed in opposite directions, as indicated by arrows 88 and 89. The spiral edges 84 and 86 have the same pitch and same hand. Both discs 80 and 82 pump outward at a same rate. However, the refining on the material is improved because of the increased number of crossovers resulting from the sinuous nature of the refining edges 84 and 86. Moreover, the sinuous spiral refining edges 84 and 86 create pockets 87 which contribute to increase the shear action of the material to be refined, thereby further improving the refining.

Figure 7:
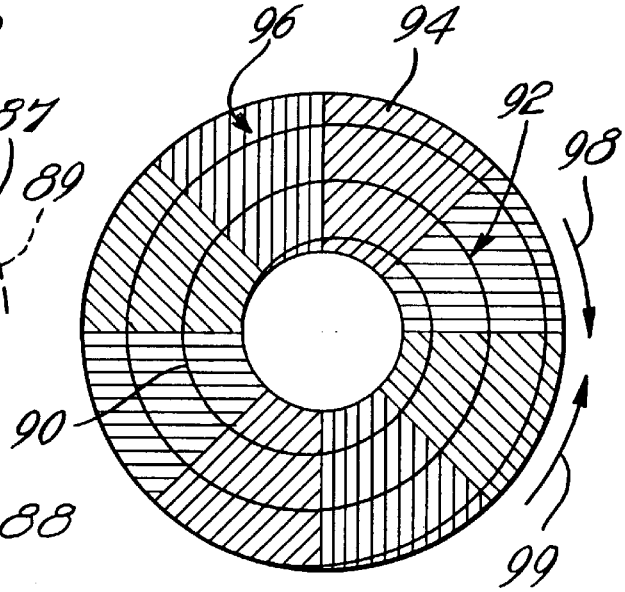
FIG. 7 is a diagrammatic, superposed view of a cooperating pair of different refining patterns in accordance with a further general embodiment of the present invention.

FIG. 7 illustrates the mating of a plain spiral refining edge 90 of a disc 92 with portions of conventional refiner patterns 94 of a companion disc 96. The number of crossovers is greater than what is obtained for plain spirals of equal pitch in an equal size apparatus. The discs 92 and 96 are rotated at a same speed in opposite directions, as indicated by arrows 98 and 99, respectively. The hydraulic shear between the outward flow caused by the centrifugal action of the disc 96 on the material and the inward flow generated by the disc 92 is increased as compared to crossovers and shear using plain spiral of equal pitch. Refining, therefore is improved.

In operation, the refining edges act as dams. Therefore, the material advances at the speed of land advance, like a screw conveyor, with material being conveyed mainly in the grooves between the lands. The passage of one work surface against the other maintains a turbulence on the material in the grooves. A lesser amount of material is conveyed during its advance while pinched in the crossovers. Spiral crossovers are much longer than crossovers of conventional refining patterns, whereby spiral crossovers tend to roll material in their pinch rather than to hammer and chop the material. Therefore, the spiral improves the refining by retaining fiber length.

Other combinations would be apparent to an artisan. For example, one need not have a rotary pattern on both sides of a refining zone, stationary patterns being common. Using a stator, the rotor must do all the pumping, the flow thereby being less than when two rotors pump outward. A change in pitch from right to left hand may be seen as a change from positive pitch to negative pitch. A zero pitch could be represented by a circle which, of course, could not pump. Thus a stationary pattern, i.e. a stator, could have any chosen pitch, either positive or negative, including a zero pitch.

Finally, it is pointed out that the spiral principle according to the present invention, besides being utilized as a plate or disc, can be utilized as a cone.

What is claimed is:

1. In a pulp refiner comprising a pair of cooperating refiner members having opposed facing refining surfaces defining a gap therebetween for receiving a material to be refined, each said refining surface being formed with alternating grooves and lands, the lands of one refining surface intersecting the lands of the other refining surface to form crossovers therewith, wherein at least one of said refiner member is rotatable, and wherein said grooves and lands defined in said at least one refiner member extend in a continuous spiral pattern of at least one revolution for providing a screw-like pumping action on the material when said at least one refiner member is rotated, said continuous spiral pattern of said at least one refiner member being different from a refining pattern of the other cooperating refiner member to provide additional crossovers and increased hydraulic shear between said refining surfaces, wherein said spiral pattern has a pitch different from that of said refining pattern of said other cooperating refiner member, and wherein the grooves and lands on said other cooperating refiner member extend continuously in a curvilinear pattern of at least one revolution.

2. In a pulp refiner as defined in claim 1, wherein said grooves and lands on said other cooperating refiner member defines a spiral pattern, wherein said spiral patterns of said refiner members have respective hands, and wherein said hands and the direction of rotation of said refiner members are such that the material is pumped outwardly by both said refiner members but at a different rate because of the different pitch of said patterns of said refiner members.

3. In a pulp refiner as defined in claim 2, wherein said hands of said spiral patterns are the same, and wherein said refiner members are rotated in opposite directions.

4. In a pulp refiner as defined in claim 1, wherein said patterns of said refiner members have respective hands, and wherein said hands and the direction of rotation of said refiner members are such that the material is pumped outwardly by the refiner member having a higher pitch and inwardly by the refiner member of lesser pitch.

5. In a pulp refiner as defined in claim 4, wherein said pattern of said refiner member of lesser pitch extends in the same direction as the direction of rotation of said refiner member of higher pitch.

6. In a pulp refiner as defined in claim 1, wherein said spiral pattern is sinuous.

7. In a pulp refiner as defined in claim 1, wherein said grooves and lands of said other refiner member are arranged to impart a centrifugal force to the material being refined when said other refiner member is rotated, whereas said at least one refiner member is adapted to exert a screw pumping action on the material, and wherein said spiral pattern extends from a central region of said at least one refiner member to a periphery thereof.

8. In a pulp refiner as defined in claim 7, wherein said hand of said spiral pattern of at least one refiner member and said direction of rotation thereof are selected to produce an inward flow of material, while said other refiner member generates a centrifugal flow of material.

9. In a pulp refiner as defined in claim 1, wherein said cooperating refiner members are provided in the form of discs.

10. In a pulp refiner as defined in claim 1, wherein said cooperating refiner members are conical in shape.

11. In a pulp refiner comprising a pair of cooperating refiner members having opposed facing refining surfaces defining a gap therebetween for receiving a material to be refined, each said refining surface being formed with alternating grooves and lands, the lands of one refining surface intersecting the lands of the other refining surface to form crossovers therewith, wherein at least one of said refiner members is rotatable, and wherein said grooves and lands defined in said at least one refiner member extend along a continuous spiral pattern of at least one revolution for providing a screw-like pumping action on the material when said at least one refiner member is rotated, said lands of said at least one refiner member being sinuously curved along said spiral pattern, thereby providing additional crossovers between said refining surfaces.

12. In a pulp refiner as defined in claim 11, wherein said grooves and lands of said other refiner member also extend in a spiral pattern of at least one revolution.

13. In a pulp refiner as defined in claim 12, wherein said spiral patterns of said cooperating refiner members have different pitch.

14. A method of refining material, comprising the steps of: providing a pair of refining surfaces having different refining patterns, one of said refining pattern including a spiral while the refining pattern of the other refining surface describes a curvilinear pattern of at least one revolution, setting the pitch of the spiral to have more turns than the refining pattern of the other refining surface so as to increase a total area of bar crossings, thereby providing for a differential pumping action between the refining surfaces, which results in increased hydraulic shear between the refining surfaces, operating said refining surfaces by rotating at least one of said refining surfaces to impart a screw-like pumping and pinching action to the material to be refined, and introducing the material to be refined between said refining surfaces, wherein the increased area of bar crossings and the increased hydraulic shear together increase refining on the material.

15. A method as defined in claim 14, wherein the step of operating said refining surfaces is effected by rotating said refining surfaces so as to introduce a differential pumping action therebetween.

* * * * *